US010993506B2

(12) United States Patent
Dong

(10) Patent No.: US 10,993,506 B2
(45) Date of Patent: May 4, 2021

(54) UNIVERSAL DOUBLE-SIDED BELT BUCKLE

(71) Applicant: CCF Cufflink Co., Ltd.Quanzhou, Fujian (CN)

(72) Inventor: Xinrong Dong, Fujian (CN)

( * ) Notice: Subject to any disclaimer, the term of this patent is extended or adjusted under 35 U.S.C. 154(b) by 0 days.

(21) Appl. No.: 16/559,649

(22) Filed: Sep. 4, 2019

(65) Prior Publication Data

US 2021/0022455 A1 Jan. 28, 2021

(30) Foreign Application Priority Data

Jul. 27, 2019 (CN) ..... 201910685339.2

(51) Int. Cl.
*A44B 11/24* (2006.01)

(52) U.S. Cl.
CPC ..... *A44B 11/24* (2013.01)

(58) Field of Classification Search
CPC ..... A44B 11/24; A44B 11/25
See application file for complete search history.

(56) References Cited

U.S. PATENT DOCUMENTS 2,186,819 A * 1/1940 Buchsbaum ..... A44B 11/24 24/178
2,443,805 A * 6/1948 Segal ..... 24/188
4,458,390 A * 7/1984 Fogelson ..... A44B 11/006 24/182
8,365,364 B2 * 2/2013 Labelson ..... A44B 11/006 24/163 R
9,320,325 B2 * 4/2016 Chen ..... A44B 11/006
9,930,936 B2 * 4/2018 Liu ..... A44B 11/006
2015/0107002 A1 * 4/2015 Wang ..... A41F 9/002 2/338
2020/0022461 A1 * 1/2020 Huang ..... A44B 11/24

FOREIGN PATENT DOCUMENTS

FR 1342733 A * 11/1963 ..... A44B 11/24
GB 278297 A * 10/1927 ..... A44B 11/24

* cited by examiner

*Primary Examiner* — Victor D Batson
*Assistant Examiner* — Matthew J Sullivan
(74) *Attorney, Agent, or Firm* — Prakash Nama; Global IP Services, PLLC

(57) ABSTRACT

The invention relates to a universal double-sided belt buckle, which comprises a buckle body, a mounting member and a buckle pin, the left end of an upper sheet body and the left end of a lower sheet body are both integrally formed with extension sheets extending downwards, a clamping interval is arranged between the free ends of the two extension sheets, the left side of the mounting member, at the position corresponding to the first end of the buckle pin, is concavely provided with an accommodating recess which is communicated with the through concave cavity and used to accommodate the part of the buckle pin positioned at the mounting member and make it be able to rotate. Compared with the prior art, the buckle body is detachably connected with the mounting member, so that the utilization rate of the buckle body is improved.

5 Claims, 2 Drawing Sheets

UNIVERSAL DOUBLE-SIDED BELT BUCKLE

BACKGROUND OF THE INVENTION

The invention relates to a clothing wearing accessory, in particular to a belt buckle applied to trousers.

The structure of the existing belt consists of a belt body and a belt buckle, wherein the belt buckle has a buckle body, a mounting member and a buckle pin, the buckle body is a square frame body enclosed by a four-rod body, one end of the buckle pin is movably hung outside one rod body of the buckle body, the other end of the buckle pin extends towards the opposite rod body direction, the rod body with the buckle pin, the rod body being on the buckle body is fixedly connected with the mounting member. One side of the mounting member, which is back to the buckle body, is concavely provided with a containing groove for one end of the belt body to extend into the containing groove, and when in use, the other end of the belt body extends into the hollow cavity of the buckle body, and the buckle pin passes through the perforation of the belt body, then the belt can be enclosed into a closed-loop ring body, thereby achieving girdling waist of human body by the belt.

In case of the existing belt buckle, in order to avoid the movement of the belt body when in use, the buckle body or the mounting member will be fixedly provided with a belt loop for the other end of the belt body to pass through and limit the belt body. The belt loop is basically a portal frame structure formed by two vertically arranged side rods and an upper cross rod integrally formed with the upper ends of the two side rods in an enclosing way, and the upper cross rod is positioned above the belt buckle. As is well known, the short service life of the existing belt is the abrasion of one surface of the belt body, the other surface of the belt body cannot be damaged, but the belt loop is fixed, so that the buckle body cannot be used on two sides, causing that the belt buckle with the belt loop cannot be used on two sides, and the buckle body, the mounting member and the buckle pin are fixedly matched, so that the style of the belt buckle can only be fixed, and the universality and the use flexibility are poor.

In view of the above, the present inventors have conducted intensive studies to solve the above problems and have made the present invention.

BRIEF SUMMARY OF THE INVENTION

The object of the invention is to provide a universal double-sided belt buckle, for solving the problems in the prior art caused by the fixed matching of the buckle body, the mounting member and the buckle pin, namely, poor universality and use flexibility, incapability of double-sided use due to belt loop fixation, and short service life.

In order to achieve the purpose, the invention adopts the following technical scheme.

A universal double-sided belt buckle comprises a buckle body, a mounting member, a buckle pin and a belt loop, wherein the buckle body is positioned at the left side of the mounting member, the first end of the buckle pin is rotatably mounted on the right side of the buckle body, the second end of the buckle pin extends leftwards to the left side of the buckle body, the right side of the mounting member is provided with a mounting groove for the belt body to extend into and mount, the belt loop is provided with two opposite side rods and an upper cross rod which is integrally connected with the upper ends of the two side rods, the lower ends of the two side rods are correspondingly connected with the front surface and rear side surface of the mounting member, and the upper cross rod is positioned above the mounting member; it is characterized in that: the right side of the buckle body is provided with an mounting rod body extending along the front-rear direction, the left-right direction width of the mounting rod body is smaller than the up-down direction width of the mounting rod body, the left side of the mounting member is provided with a through concave cavity extending rightwards and penetrating through the front and rear sides of the mounting member, the up-down direction width of the through concave cavity is larger than the up-down direction width of the mounting rod body, the up-down direction width of the cavity opening of the through concave cavity is matched with the left-right direction width of the mounting rod body, the cavity opening being towards the mounting rod body, the mounting rod body is clamped into the through concave cavity through the cavity opening on the left side of the through concave cavity and is rotatably arranged in the through concave cavity, and the left side of the mounting member, at the position corresponding to the first end of the buckle pin, is concavely provided with an accommodating recess which is communicated with the through concave cavity and used to accommodate the part of the buckle pin positioned at the mounting member and make it be able to rotate; the two side rods of the belt loop are respectively movably hinged to the front side wall and the rear side wall of the mounting member, and the distance between the hinged point of the side rod and the mounting member and the upper cross rod is longer than the distance between the hinged point of the side rod and the mounting member and the left side surface of the mounting member.

The left side surface and the right side surface of the mounting rod body are both straight surfaces, and the mounting rod body is arranged in a leftward or rightward inclined mode.

The first end of the buckle pin integrally extends to form a hook portion which is hooked leftwards to form an arc-shaped cavity, the free end of the hook portion is positioned below the bottom surface of the buckle pin, and is provided with an insertion port communicated with the arc-shaped cavity, the insertion port being between the hook portion and the lower bottom surface of the buckle pin, the aperture of the insertion port is larger than the left-right direction width of the mounting rod body and smaller than the up-down direction width of the mounting rod body, the left side surface and the right side surface of the mounting rod body are both convexly provided with convex arc-shaped blocks, the hook portion is buckled outside the mounting rod body through the insertion port, the part of the mounting rod body, the part being positioned at the convex arc-shaped blocks is positioned in the hook portion, and the hook portion is positioned in the accommodating recess.

The portion of mounting member located at the through concave cavity is formed with an upper sheet body and a lower sheet body, the interval between the upper sheet body and the lower sheet body is larger than the up-down direction width of the mounting rod body, the left end of the upper sheet body and the left end of lower sheet body are both integrally formed with extension sheets extending downwards, a clamping interval is provided between the free end portions of the two extension sheets, and the width of the clamping interval is matched with the left-right direction width of the mounting rod body.

In the front and rear ends of the through concave cavity are both provided with an elastic limiting member, the elastic limiting member is provided with an upper transverse portion extending along the left-right direction of the mounting member and a lower transverse portion positioned below the upper transverse portion and provided with an interval so as to be able to be relatively extruded and elastically deformed, the right side of the upper transverse portion and the right side of the lower transverse portion are integrally connected by a U-shaped elbow, the upper transverse portion, the lower transverse portion and the U-shaped elbow form a horizontally arranged U-shaped member in an enclosing way, a connecting sheet is integrally formed between the right side of the upper sheet body and the right side of the lower sheet body, the front side surface and the rear side surface of the connecting sheet are respectively outwards and convexly provided with a U-shaped convex block lying horizontally in the left-right direction, a U-shaped channel matched with the U-shaped structure of the elastic limiting member is arranged between the outer side wall of the U-shaped convex block and the cavity wall of the through concave cavity, the elastic limiting member is compressed and socketed outside the U-shaped convex block and is matched with the U-shaped channel, the left end of the upper transverse portion and the left end of the lower transverse portion are positioned outside the left side of the mounting rod body in the through concave cavity, the left end of the upper transverse portion and the left end of the lower transverse portion are provided with limiting bulges which are oppositely arranged, the distance between the two limiting bulges is shorter than the left-right direction width of the mounting rod body, an upper interval is reserved between the top surface of the upper limiting bulge and the upper sheet body, and a lower interval is reserved between the bottom surface of the lower limiting bulge and the lower sheet body.

The left side edge of the upper sheet body is provided with an upper arc-shaped chamfer sheet extending downwards, the upper arc-shaped chamfer sheet is an extension sheet of the upper sheet body, the upper arc-shaped chamfer sheet is upwards concavely provided with an upper step at the elastic limiting member, the left side edge of the lower sheet body is provided with a lower arc-shaped chamfer sheet extending upwards, the lower arc-shaped chamfer sheet is an extension sheet of the lower sheet body, the lower arc-shaped chamfer sheet is downwards concavely provided with a lower step at the elastic limiting member, the free end of the upper transverse portion integrally extends to form an upper arc-shaped limiting block, the top surface of which is a concave arc-shaped surface which concaves downwardly, the upper arc-shaped limiting block is the limiting bulge of the upper transverse portion, the upper arc-shaped limiting block is opposite to the upper arc-shaped chamfer sheet, the left side edge of the upper arc-shaped limiting block is positioned at the upper step, and the part of the upper arc-shaped chamfer sheet positioned at the upper step falls into the range of the concave cavity of the upper arc-shaped limiting block and is provided with an interval which is the upper space; the free end of the lower transverse portion integrally extends to form a lower arc-shaped limiting block, the top surface of which is a convex arc-shaped surface which convex upwardly, the lower arc-shaped limiting block is the limiting bulge of the lower transverse portion, the lower arc-shaped limiting block is opposite to the lower arc-shaped chamfer sheet, the left edge of the lower arc-shaped limiting block is positioned at the lower step, and the part of the lower arc-shaped chamfer sheet positioned at the lower step falls into the range of the concave cavity of the bottom surface of the lower arc-shaped limiting block and is provided with an interval which is the lower interval, and the distance between the highest convex portion of the top surface of the lower arc-shaped limiting block and the bottommost portion of the bottom surface of the upper arc-shaped limiting block is shorter than the width of the mounting rod body.

The distance between the upper transverse portion and the lower transverse portion of the U-shaped member is gradually increased from left to right, the parts of the U-shaped channel which are between the U-shaped convex blocks and the upper sheet body and the lower sheet body are both straight channels, and the distance between the two straight channels is shorter than the maximum distance between the upper transverse portion and the lower transverse portion.

The two U-shaped convex blocks are provided with punching holes extending along the front-rear direction, the portions of the connecting sheets positioned at the punching holes are correspondingly provided with through holes, the two punching holes are communicated with the through holes to form a shaft hole, the shaft hole is provided with a pin shaft, the two ends of which correspondingly extend out of the shaft hole and correspondingly rotate one by one to extend out of the two side rods, and the two ends of the pin shaft are provided with limiting heads for limiting the ends of the pin shaft outside the side rods.

The left side of the front side wall and the left side of the rear side wall of the mounting member are both inwards concavely provided with an accommodating concave step, the through concave cavity is positioned in the range of the accommodating concave step, the lower ends of the side rods are positioned in the accommodating concave step, and the end surfaces of the lower ends of the side rods are convex cambered surfaces which are downwards convex.

By adopting the technical scheme, in case of the universal double-sided belt buckle according to the invention, because the left-right direction width of the mounting rod body is smaller than the up-down direction width of the mounting rod body, when mounted, the mounting rod body is in a vertical state, so that the left-right direction width of the mounting rod body is corresponding to the cavity opening of the through concave cavity. At the moment, the mounting rod body can be clamped into the through concave cavity from the cavity opening in a straight and tight fit manner by pushing with a slight force, and then the buckle body is in a straight state by rotating the buckle body. At the moment, the mounting rod body is not prone to sliding out of the through concave cavity because the up-down direction width of the mounting rod body is larger than the cavity opening of the through concave cavity, thereby completing the mounting of the buckle body and the mounting member. Correspondingly, the mounting rod body is erected again, then the mounting rod body can be released from the through concave cavity by pulling straightly and outwards with a slight force, thereby achieving the separation of the buckle body from the mounting member. Meanwhile, the belt loop can turn downwards or upwards around the hinge point due to the rotational matching of the side rod and the mounting member, the distance between the hinge point of the side rod and the mounting member and the upper cross bar is longer than the distance between the hinge point of the side rod and the mounting member and the left side surface of the mounting member, and the belt loop can turn downwards to below the buckle body.

The universal double-sided belt buckle has the following beneficial effects:

first, the buckle body 1 and the mounting member 2 are assembled in a detachable way, and the belt loop 4 can be upwards turned to above the buckle body or downwards turned to below the buckle body, so that the belt buckle can be used on both sides, and the service life of the belt buckle is greatly prolonged;

second, the buckle body 1, the mounting member 2 and the buckle pin 3 are detachably combined, so that buckle bodies, mounting members and buckle pins of different styles or colors can be freely combined for use, and thus it is able to combine belt buckles of different styles and colors, so that the universality is high, the use is flexible and various, and the utilization rate of the whole belt buckle is obviously improved;

third, when one part of the belt buckle is damaged, it is not needed to discard the whole belt buckle, and it is only need to replace the damaged part, so that the use cost of a consumer is greatly reduced;

fourth, when used, different buckle bodies and buckle pins can be combined with the same belt body for use to obtain belts with different styles and/or colors, so that consumers only need to buy one belt body and a plurality of buckle bodies or a plurality of belt bodies and one buckle body and combine them to form the belts with different styles, and not need to match one buckle body for each belt body, therefore the use cost is greatly saved, and the universality is high; and fifth, the integral structure is simple and easy, so that the processing and the manufacturing are simple, meanwhile, other tools are not needed to assist when disassembling and assembling, and the disassembly and the assembly can be directly carried out by bare hands, so that the use is convenient.

DETAILED DESCRIPTION OF THE INVENTION

For further explanation of the technical solution of the present invention, the following detailed description is made with reference to the accompanying drawings.

Figure 1:
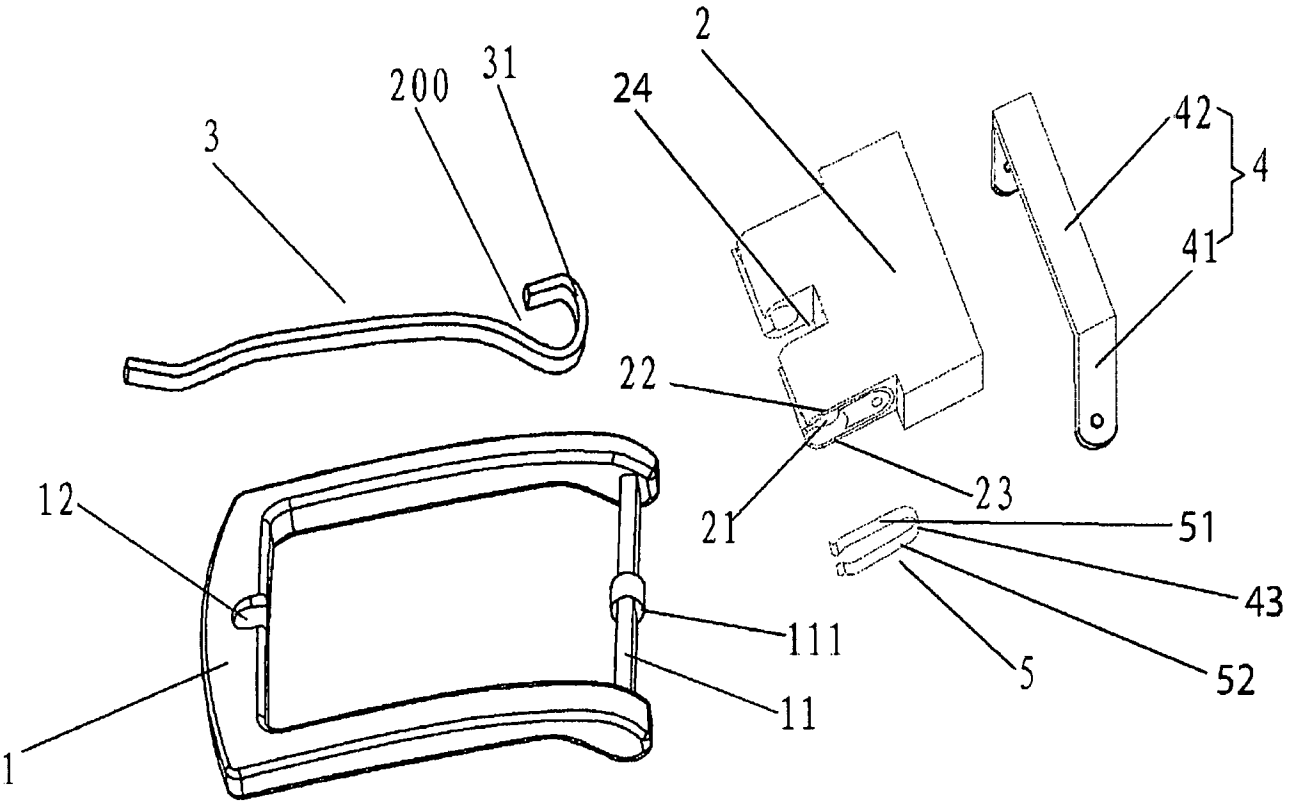
FIG. 1 is a schematic structural view of the present invention.
Figure 2:
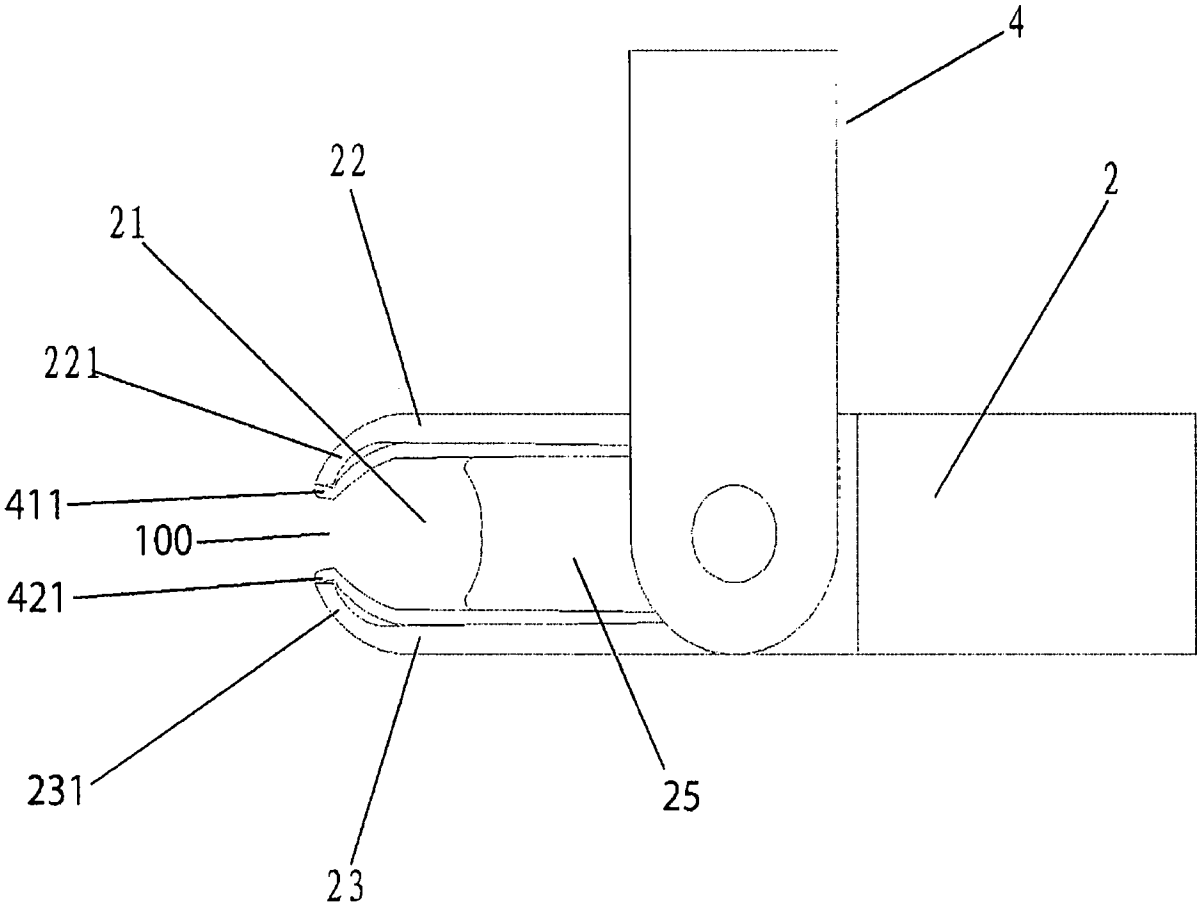
FIG. 2 is a schematic structural view of the mounting member according to the present invention.

As shown in FIGS. 1-2, a universal double-sided belt buckle according to the present invention comprises a buckle body 1, a mounting member 2, a buckle pin 3 and a belt loop 4, wherein the buckle body 1 is positioned at the left side of the mounting member, and the right side of the buckle body 1 is provided with a mounting rod body 11, namely, the buckle body 1 is a hollow square frame body formed by an enclosure of a four-rod body which is arranged in a front, back, left-right mode. The four-rod body is formed by integral die casting. The four-rod body is divided into a front rod body, a back rod body, a left rod body and a right rod body. The lower end of the right side of the front rod body extends downwards to form a lug, and the lower end of the right side of the back rod body extends downwards to form a lug, namely the widths of the front rod body and the back rod body are gradually expanded from left to right, the right rod body is connected between the two lugs, the right rod body is the mounting rod body 11, and the right side of the top surface of the left rod body of the buckle body 1 is concave downwards to form a buckle pin positioning recess 12 communicated with the hollow cavity of the buckle body. In the present invention, the structure of the buckle body 1 is not limited to the square frame structure described above, and a plate-type buckle body or a circular buckle body may be applied.

The left-right direction width of the mounting rod body 11 is smaller than the up-down direction width of the mounting rod body 11, preferably, the left side surface and the right side surface of the mounting rod body 11 are both flat surfaces. The side length of the left side surface and the right side surface of the mounting rod body 11 in the up-down direction is larger than the side length of the upper top surface and the lower bottom surface of the mounting rod body 11 in the left-right direction, and the front side surface and the rear side surface of the mounting rod body 11 are both arc-shaped surfaces.

The mounting rod body 11 is connected with the left side of the mounting member 2. The right side of the mounting member 2 is provided with a mounting groove (not shown in the figures) for the belt body to extend into and mount. The mounting member 2 is preferably a square block body with a certain thickness. The right side surface of the mounting member 2 is leftwards and concavely provided with a strip-shaped square groove extending in front-rear direction, and the strip-shaped square groove is the mounting groove. One end of the belt body of the belt is tightly fitted into the mounting groove and is locked and fixed by a screw to realize the mounting of the belt body. The left side surface of the mounting member 2 is rightwards and concavely provided with a through concave cavity 21 penetrating through the front side and the rear side of the mounting member. The up-down direction width of the through concave cavity 21 is larger than that of the mounting rod body 11, and the up-down direction width of the cavity opening, which is towards the mounting rod body, of the through concave cavity 21 is matched with the left-right direction width of the mounting rod body. The mounting rod body 11 is clamped into the through concave cavity 21 through the cavity opening on the left side of the through concave cavity 21 and is rotatably arranged in the through concave cavity 21. Preferably, the cavity bottom of the through concave cavity 21 (i.e., the right inner cavity wall of the through concave cavity 21) is a concave arc-shaped surface. The cross section of the cavity 21 is a horizontally arranged U-shaped structure with a U-shaped opening facing left. The portion of mounting member 2 located at the through concave cavity 21 is formed with an upper sheet body 22 and a lower sheet body 23, the up-down direction width of the cavity 21 is larger than the up-down direction width of the mounting rod 11, namely, the mounting rod body 11 can move and rotate in the through concave cavity 21. The left end of the upper sheet body 22 and the left end of the lower sheet body 23 are both integrally formed with extension sheets. The extension sheet extending downwardly is preferably an upper arc-shaped chamfer sheet 221 extending downwards, and the extension sheet extending upwardly is preferably a lower arc-shaped chamfer sheet 231 extending upwards, that is, the free end portions of the upper sheet body and the lower sheet body are both extended with chamfer portions. A clamping interval 100 is provided between the free end portions of the two extension sheets. The width of the clamping interval 100 is matched with the left-right direction width of the mounting rod body 11, that is, just for the mounting rod body 11 to clamp in. The mounting rod body 11 is clamped into the through concave cavity 21 through the clamping interval and is rotatably arranged in the through concave cavity 21.

The first end of the buckle pin 3 is rotatably arranged on the mounting rod body 11, the second end of the buckle pin 3 extends to the left rod body, and the second end of the buckle pin 3 is clamped into the buckle pin positioning recess 12. Preferably, the first end of the buckle pin integrally extends to form a hook portion 31 which is hooked leftwards to form an arc-shaped cavity. The hook portion 31 is similar to a U-shaped elbow, and the free end of the hook portion 31 is positioned below the bottom surface of the buckle pin 3, and is provided with an insertion port 200, communicated with the arc-shaped cavity, between the lower bottom surface of the buckle pin 3. The aperture of the insertion port 200 is larger than the left-right direction width of the mounting rod body 11 and smaller than the up-down direction width of the mounting rod body 11. The left side surface and the right side surface of the mounting rod body 11 are both convexly provided with convex arc-shaped blocks 111. The hook portion 31 is buckled outside the mounting rod body 11 through the insertion port 200, and the part of the mounting rod body 11 positioned at the convex arc-shaped blocks 111 is positioned in the hook portion 31, so that the mounting rod body 11 and the buckle pin 3 can rotate relatively. The left side of the mounting member 2, at the position corresponding to the first end of the buckle pin 3, is concavely provided with an accommodating recess 24 which is communicated with the through concave cavity 21 and used to accommodate the hook portion 3 and make it be able to rotate, namely, the middle part of the left side surface of the mounting member 2 is rightwards and concavely provided with a square groove. The square groove penetrates through the upper end surface and the lower end surface of the mounting member 2, and the hook portion 31 is positioned in the accommodating recess.

The belt loop 4 is provided with two side rods 41 which are opposite at front and rear and an upper cross rod 42 which is integrally connected with the upper ends of the two side rods. The lower ends of the two side rods 41 are correspondingly and movably hinged on the front surface and rear side surface of the mounting member 2. The upper cross rod 42 is positioned above the mounting member 2. The two side rods of the belt loop 4 are respectively and movably hinged on the front side wall and the back side wall of the mounting member, and the distance between the hinged point of the side rods 41 and the mounting member 2 and the upper cross rod 42 is longer than the distance between the hinged point of the side rods 41 and the mounting member 2 and the left side surface (namely the left rod body) of the mounting member.

In case of the universal double-sided belt buckle according to the invention, the left-right direction width of the mounting rod body 11 is smaller than the up-down direction width of the mounting rod body. When mounted, the mounting rod body 11 is in a vertical state, so that the left-right direction width of the mounting rod body 11 is corresponding to the cavity opening of the through concave cavity 21. At the moment, the mounting rod body 11 can be clamped into the through concave cavity 21 from the cavity opening in a straight and tight fit manner by pushing with a slight force, and then the buckle body 1 is in a straight state by rotating the buckle body 1. At the moment, the mounting rod body 11 is not prone to sliding out of the through concave cavity 21 because the up-down direction width of the mounting rod body 11 is larger than the cavity opening of the through concave cavity 21, thereby completing the mounting of the buckle body 1 and the mounting member 2. Correspondingly, the mounting rod body 11 is erected again, then the mounting rod body can be released from the through concave cavity 21 by pulling straightly and outwards with a slight force, thereby achieving the separation of the buckle body 1 from the mounting member 2. Meanwhile, the belt loop 4 can turn downwards or upwards around the hinge point due to the rotational matching of the side rod 41 and the mounting member 2, the distance between the hinge point of the side rod 41 and the mounting member 2 and the upper cross bar is longer than the distance between the hinge point of the side rod and the mounting member and the left side surface of the mounting member, and the belt loop 4 can turn downwards to below the buckle body.

The universal double-sided belt buckle has the following beneficial effects:

first, the buckle body 1 and the mounting member 2 are assembled in a detachable way, and the belt loop 4 can be upwards turned to above the buckle body or downwards turned to below the buckle body, so that the belt buckle can be used on both sides, and the service life of the belt buckle is greatly prolonged;

second, the buckle body 1, the mounting member 2 and the buckle pin 3 are detachably combined, so that buckle bodies, mounting members and buckle pins of different styles or colors can be freely combined for use, and thus it is able to combine belt buckles of different styles and colors, so that the universality is high, the use is flexible and various, and the utilization rate of the whole belt buckle is obviously improved;

third, when one part of the belt buckle is damaged, it is not needed to discard the whole belt buckle, and it is only need to replace the damaged part, so that the use cost of a consumer is greatly reduced;

fourth, when used, different buckle bodies and buckle pins can be combined with the same belt body for use to obtain belts with different styles and/or colors, so that consumers only need to buy one belt body and a plurality of buckle bodies or a plurality of belt bodies and one buckle body and combine them to form the belts with different styles, and not need to match one buckle body for each belt body, therefore the use cost is greatly saved, and the universality is high;

fifth, the hook portion 31 can be replaced due to the arrangement of the hook portion 31, so that the buckle body can be matched with the buckle pins 3 with different colors, therefore the decoration is stronger, and the use universality is further improved; and sixth, the integral structure is simple and easy, so that the processing and the manufacturing are simple, meanwhile, other tools are not needed to assist when disassembling and assembling, and the disassembly and the assembly can be directly carried out by bare hands, so that the use is convenient.

In case of the universal double-sided belt buckle according to the invention, the left side surface and the right side surface of the mounting rod body 11 are both straight surfaces, and the mounting rod body 11 is arranged in a leftward or rightward inclined mode, wherein the inclined angle of the mounting rod body 11 is preferably 5-10 degrees. In this way, the disassembly and assembly of the mounting rod body and the mounting member is relatively smooth through the straight faces of the mounting rod body 11, and the inclined arrangement makes it more difficult for the mounting rod body 11 to be separated from the through concave cavity, and the use stability is guaranteed again.

For the universal double-sided belt buckle according to the invention, further preferably, in the front and rear ends of the through concave cavity 21 are both provided with an elastic limiting member 5. The elastic limiting member 5 is made of rigid material and is a rigid member. The elastic limiting member 5 is provided with an upper transverse portion 51 extending along the left-right direction of the mounting member and a lower transverse portion 52 positioned below the upper transverse portion 51 and provided with an interval. The right side of the upper transverse portion 51 and the right side of the lower transverse portion 52 are integrally connected by a U-shaped elbow 43, and the upper transverse portion 51 the lower transverse portion 52 and the U-shaped elbow 43 form a horizontally arranged U-shaped member in an enclosing way. Because the upper transverse portion 51 and the lower transverse portion 52 have a certain interval, they can be relatively extruded and pressed to generate a certain elasticity. The interval between the upper transverse portion 51 and the lower transverse portion 52 is gradually increased from left to right, namely, the two members of the U-shaped member are in a non-straight structure. The maximum distance between the upper transverse portion 51 and the lower transverse portion 52 is larger than the distance between the upper sheet body 22 and the lower sheet body 23, that is, when being laid horizontally, the elastic limiting member 5 cannot be clamped into the through concave cavity 21, and can be clamped into the through concave cavity 21 only after being pressed, so that the elastic limiting member 5 cannot fall out of the through concave cavity 21.

Connecting members (not shown in the figures) are connected between the front end of the right side of the upper sheet body 22 and the front end of the right side of the lower sheet body 23 and between the rear end of the right side of the upper sheet body 22 and the rear end of the right side of the lower sheet body 23. The connecting members are positioned on the right side of the mounting rod body 11 in the through concave cavity 21 namely, the left side of the through concave cavity 21 is used for accommodating the rod body 11. The front end and the rear end of the right side of the through concave cavity 21 are respectively provided with a connecting sheet, and the opposite surfaces of the two connecting sheets are both convexly provided with a U-shaped convex block 25 lying horizontally in the left-right direction. The upper top surface and the lower top surface of the U-shaped convex block 25 are both flat surfaces. The U-shaped elbow of the U-shaped convex block 25 is positioned at the right side. The cavity bottom of the through concave cavity 21 is positioned at the concave arc-shaped structure, which correspondingly has concave rightwards, of the U-shaped convex block 25. Between the upper top surface of the U-shaped convex block and the upper sheet body, the lower bottom surface of the U-shaped convex block and the lower sheet body, and the U-shaped elbow and the concave arc-shaped structure respectively form with an interval and form an arc-shaped concave cavity in an enclosing way, namely, an upper interval is reserved between the top surface of the U-shaped convex block and the upper sheet body, a lower interval is reserved between the bottom surface of the U-shaped convex block and the lower sheet body, and a right interval is reserved between the right side surface of the U-shaped convex block and the right side surface of the through concave cavity 21. The upper interval, the lower interval and the right interval are communicated to form a U-shaped channel. The width of the U-shaped channel is matched with the thickness of the elastic limiting member 5. The U-shaped channel is positioned on the surfaces of the two connecting sheets which are opposite to each other, namely, the U-shaped channel is communicated with the side opening of the through concave cavity 21. The elastic limiting member 5 is elastically compressed and socketed outside the U-shaped convex block 25 and matched with the arc-shaped concave cavity, namely, when the upper transverse portion 51 and the lower transverse portion 52 are pressed relatively, the upper transverse portion 51 and the lower transverse portion 52 are directly pressed into the arc-shaped concave cavity from the side opening of the through concave cavity 21. Because the width of the U-shaped channel is matched with the thickness of the elastic limiting member 5, namely, the upper transverse portion 51 is clamped between the upper transverse portion 51 and the top surface of the U-shaped convex block, the lower transverse portion 52 is clamped between the lower transverse portion 52 and the bottom surface of the U-shaped convex block, and the left end of the upper transverse portion 51 and the left end of the lower transverse portion 52 are both positioned outside the left side of the mounting rod body 11 in the through concave cavity 21, namely, the left ends of the upper transverse portion 51 and the lower transverse portion 52 extend to the cavity opening of the through concave cavity 21. The left end of the upper transverse portion 51 and the left end of the lower transverse portion 52 are provided with limiting bulges which are oppositely arranged. The distance between the two limiting bulges is shorter than the thickness of the mounting rod body 11 positioned on the two cutting planes, and an interval is reserved between the top surface of the upper limiting bulge and the upper sheet body, and an interval is reserved between the bottom surface of the lower limiting bulge and the lower sheet body, so that the portions of the elastic limiting member 5 at the two limiting bulges can be opened back to back by utilizing the intervals; when the mounting rod body 11 is clamped into the through concave cavity 21 by means of the elastic limiting member 5 and then moves to the two limiting bulges, the mounting rod body 11 is strongly force the upper transverse portion 51 and the lower transverse portion 52 to open back to back and slide into the interval between the upper transverse portion 51 and the lower transverse portion 52 of the elastic limiting member 5. The two limiting bulges are correspondingly and elastically reset, the mounting rod body is positioned in the range between the limiting bulges and the U-shaped convex block, and meanwhile, the interval between the two limiting bulges is smaller than the thickness of the mounting rod body, so that the mounting rod body is further limited from being separated from the mounting member 2, and the use reliability is better. Also, the structure of the elastic limiting member 5 is easy to disassemble, assemble and replace for the whole buckle body, so that the use is convenient, each component can be replaced separately after being damaged, and the usage rate of buckle body can be improved progressively.

The left side edge of the upper sheet body 22 is provided with an upper arc-shaped chamfer sheet 221 extending downwards, the upper arc-shaped chamfer sheet is an extension sheet of the upper sheet body, and the upper arc-shaped chamfer sheet is upwards concavely provided with an upper step at the upper transverse portion 51 of the elastic limiting member 5. The left side edge of the lower sheet body 23 is provided with a lower arc-shaped chamfer sheet 231 extending upwards, the lower arc-shaped chamfer sheet is an extension sheet-234 of the lower sheet body, and the lower arc-shaped chamfer sheet is downwards concavely provided with a lower step at the lower transverse portion 52 of the elastic limiting member 5. The free end of the upper transverse portion 51 integrally extends to form an upper arc-shaped limiting block 411, the top surface of which is a concave arc-shaped surface which concaves downwardly. The upper arc-shaped limiting block 411 is opposite to the upper arc-shaped chamfer sheet. The left side edge of the upper arc-shaped limiting block 411 is positioned at the upper step, the part of the upper arc-shaped chamfer sheet positioned at the upper step falls into the range of the concave cavity of the upper arc-shaped limiting block, and an interval is reserved between the part of the upper arc-shaped chamfer sheet positioned at the upper step and the cavity bottom of the concave cavity of the upper arc-shaped limiting block. The free end of the lower transverse portion 52 integrally extends to form a lower arc-shaped limiting block 421, the top surface of which is a convex arc-shaped surface which convex upwardly. The lower arc-shaped limiting block 421 is opposite to the lower arc-shaped chamfer sheet. The left side edge of the lower arc-shaped limiting block 421 is positioned at the lower step, the part of the lower arc-shaped chamfer sheet positioned at the lower step falls into the range of the concave cavity at the bottom surface of the lower arc-shaped limiting block, and an interval is reserved between the part of the lower arc-shaped chamfer sheet positioned at the lower step and the cavity bottom of the concave cavity of the lower arc-shaped limiting block. The structures of the upper arc-shaped limiting block and the lower arc-shaped limiting block are the limiting bulges. The elastic limiting member 5 of the above structure make the mounting rod body move in smoothly, it is not affected by the two limiting blocks to not easy to clamp into the through concave cavity 21, and the limit of the elastic limiting member 5 to the mounting rod body can be ensured.

Further preferably, the front rod body and the rear rod body are both arc-shaped rods with narrow left ends and wide right ends, a right rod body is connected between the lower right portion of the front rod body and the lower right portion of the rear rod body, the upper right portion of the front rod body and the upper right portion of the rear rod body are integrally formed with a belt rod (not shown in the figures) located above the right side of the mounting member, and a passing interval for the belt body to pass through is reserved between the belt rod and the top surface of the mounting member; through the belt rod, the mounting member is not required to be provided with a belt loop for the belt body to pass through and limit, so that the structure is simpler.

In the present invention, the mounting rod body 11 is arranged in a leftward or rightward inclined manner.

The product forms of the present invention are not limited to the illustrations and examples herein, and any appropriate changes or modifications in similar manners should be construed as being within the scope of the present invention.

What is claimed is:

1. A belt buckle, comprising a buckle body, a mounting member, a buckle pin and a belt loop, wherein the mounting member has a first side and a second side; the buckle body is positioned at the second side of the mounting member, a first end of the buckle pin is rotatably mounted on a first side of the buckle body, a second end of the buckle pin extends opposite to the first end of the buckle pin to a second side of the buckle body, a belt body extends into and is mounted to the first side of the mounting member, the belt loop is provided with two opposite side rods and an upper cross rod which is integrally connected with upper ends of the two side rods, lower ends of the two side rods are correspondingly connected with a first transverse surface of the mounting member between one end of the first side of the mounting member and a corresponding one end of the second side of the mounting member and a second transverse surface of the mounting member between another end of the first side of the mounting member and a corresponding another end of the second side of the mounting member, and the upper cross rod is positioned above the mounting member; wherein the first side of the buckle body is provided with a mounting rod body extending longitudinally along the first side of the buckle body, a first width of the mounting rod body along a transverse direction from the first side of the buckle body to the second side of the buckle body is smaller than a second width of the mounting rod body along a vertical direction from an upper side of the buckle body to a lower side of the buckle body, the second side of the mounting member is provided with a through concave cavity transversely extending towards the first side of the mounting member and longitudinally penetrating through the front transverse surface and the second transverse surface of the mounting member, a width of the through concave cavity along a vertical direction from an upper side of the mounting member to a lower side of the mounting member is larger than the second width of the mounting rod body, a width of a cavity opening of the through concave cavity along a vertical direction from an upper side of the mounting member to a lower side of the mounting member matches with the first width of the mounting rod body, the cavity opening is configured to open at the second side of the mounting member towards the mounting rod body, the mounting rod body is clamped into the through concave cavity through the cavity opening and is rotatably arranged in the through concave cavity, and the second side of the mounting member is also concavely provided with an accommodating recess at a position corresponding to the first end of the buckle pin; the accommodating recess is communicated with the through concave cavity and accommodates a part of the buckle pin positioned at the mounting member to render the buckle pin rotatable; the two side rods of the belt loop are respectively movably hinged to the first transverse surface and the second transverse surface of the mounting member, and a distance between a hinging point of any one of the side rods with the mounting member and the upper cross rod is longer than a distance between the hinging point of any one of the side rods with the mounting member and the second side of the mounting member;

a first longitudinal side surface facing towards the first side of the buckle body and a second longitudinal side surface of the mounting rod body opposite to the first longitudinal side surface and facing to the second side of the buckle body are both straight surfaces, and the mounting rod body is inclined with respect to a horizontal plane between the first side of the buckle body and the second side of the buckle body; a portion of the mounting member located corresponding to the through concave cavity is formed as an upper sheet body and a lower sheet body, an interval between the upper sheet body and the lower sheet body is larger than the second width of the mounting rod body, an end of the upper sheet body and an end of lower sheet body towards the second side of the mounting member are integrally formed with an upper arc-shaped chamfer sheet and a lower arc-shaped chamfer sheet respectively which extend towards one another, a clamping interval is provided between a free end of the upper arc-shaped chamfer sheet and a free end of the lower arc-shaped chamfer sheet, and a width of the clamping interval matches with the first width of the mounting rod body;

two elastic members are arranged in the through concave cavity adjacent to the first transverse surface of the mounting member and adjacent to the second transverse mounting member respectively, each of the elastic members is provided with an upper transverse portion extending transversely along the first side of the mounting member to the second side of the mounting member, and a lower transverse portion also extending transversely along the first side of the mounting member and the second side and positioned below the upper transverse portion; an interval is provided between the upper transverse portion and the lower transverse portion so that the corresponding elastic limiting member is able to be elastically deformed, an end of the upper transverse portion towards the first side of the mounting member and an end of the lower transverse portion towards the first side of the mounting member are integrally connected by a U-shaped elbow, the upper transverse portion, the lower transverse portion and the U-shaped elbow form a horizontally arranged U-shaped member, each of the elastic limiting member is compressed on a U-shaped convex block lying horizontally along a direction from the first side of the mounting member to the second side of the mounting member, a U-shaped channel matched with each elastic limiting member is arranged between an outer side wall of each corresponding U-shaped convex block and a cavity wall of the through concave cavity, such that each elastic limiting member is socketed into the corresponding U-shaped channel and compressed on the corresponding U-shaped convex block, an end of the upper transverse portion towards the second side of the mounting member and an end of the lower transverse portion towards the second side of the mounting member are positioned in the through concave cavity at positions adjacent to the second longitudinal side surface of the mounting rod body along a direction towards the second side of the mounting member, the end of the upper transverse portion towards the second side of the mounting member is provided with an upper arc-shaped limiting block, and the end of the lower transverse portion towards the second side of the mounting member is provided with a lower arc-shaped limiting block; the upper arc-shaped limiting block and the lower arc-shaped limiting block are oppositely arranged, a distance between the upper arc-shaped limiting block and the lower arc-shaped limiting block is smaller than the first width of the mounting rod body, an upper interval is reserved between a top surface of the upper arc-shaped limiting block and the upper sheet body, and a lower interval is reserved between the a bottom surface of the lower arc-shaped limiting block and the lower sheet body.

2. The belt buckle according to claim 1, characterized in that: the first end of the buckle pin integrally extends to form a hook portion which is hooked towards the second end of the buckle pin to form an arc-shaped cavity, a free end of the hook portion is positioned below a bottom surface of the buckle pin, and is provided with an insertion port between the free end of the hook portion and the bottom surface of the buckle pin; the insertion port is communicated with the arc-shaped cavity, an aperture of the insertion port is larger than the first width of the mounting rod body and smaller than the second width of the mounting rod body, the first longitudinal side surface and the second longitudinal side surface of the mounting rod body are convexly provided with convex arc-shaped blocks respectively, the hook portion is buckled to the convex arc-shaped blocks of the mounting rod body through the insertion port, and the hook portion is positioned in the accommodating recess.

3. The belt buckle according to claim 1, characterized in that: the upper arc-shaped chamfer sheet is an extension sheet of the upper sheet body, the upper arc-shaped chamfer sheet is concaved towards the upper side of the mounting member to form an upper step at each elastic limiting member, the lower arc-shaped chamfer sheet is an extension sheet of the lower sheet body, the lower arc-shaped chamfer sheet is concaved towards the lower side of the mounting member to form a lower step at each elastic limiting member, the top surface of the upper arc-shaped limiting block is a concave arc-shaped surface which concaves towards the lower side of the mounting member, the upper arc-shaped limiting block is a limiting bulge of the upper transverse portion, the upper arc-shaped limiting block of the upper transverse portion of each elastic limiting member is opposite to the upper arc-shaped chamfer sheet, an edge of a side of the upper arc-shaped limiting block towards the second side of the mounting member is positioned at the upper step, and a part of the upper arc-shaped chamfer sheet at the upper step falls into a concave cavity of the upper arc-shaped limiting block formed by the concave arc-shaped surface formed at the top surface of the upper arc-shaped limiting block, and the upper interval is formed between the concave arc-shaped surface formed at the top surface of the upper arc-shaped limiting block and the upper step of the upper arc-shaped chamfer sheet of the upper sheet body; a top surface of the lower arc-shaped limiting block is a convex arc-shaped surface which convex towards an upper side of the mounting member, the lower arc-shaped limiting block is a limiting bulge of the lower transverse portion, the lower arc-shaped limiting block of the lower transverse portion of each elastic limiting member is opposite to the lower arc-shaped chamfer sheet, an edge of a side of the lower arc-shaped limiting block towards the second side of the mounting member is positioned at the lower step, and a part of the lower arc-shaped chamfer sheet at the lower step falls into a concave cavity of the bottom surface of the lower arc-shaped limiting block formed oppositely as a counter shape corresponding to the convex arc-shaped surface formed by the top surface of the lower arc-shaped limiting block; and the lower is formed between the concave cavity of the bottom surface of the lower arc-shaped limiting block and the lower step of the lower arc-shaped chamfer sheet of the lower sheet body, and a distance between a highest convex portion of the top surface of the lower arc-shaped limiting block and a bottommost portion of a bottom surface of the upper arc-shaped limiting block is shorter than the first width of the mounting rod body.

4. The belt buckle according to claim 1, characterized in that: the interval between the upper transverse portion and the lower transverse portion of the U-shaped member is gradually increased along a direction from the second side of the mounting member to the first side of the mounting member, two straight channels are defined in each U-shaped channel between the corresponding U-shaped convex block and the upper sheet body and between the corresponding U-shaped convex block and the lower sheet body respectively, and a distance between the two straight channels is shorter than a maximum interval between the upper transverse portion and the lower transverse portion of the corresponding elastic limiting member.

5. The belt buckle according to claim 1, characterized in that: a portion of the first transverse surface of the mounting member proximal to the second side of the mounting member and a portion of the second transverse surface of the mounting member proximal to the second side of the mounting member are each provided with an accommodating concave step recessed into the mounting member, the through concave cavity is positioned corresponding to the accommodating concave steps, the lower ends of the side rods are positioned in the accommodating concave steps respectively, and an end surface of the lower end of each of the side rods is a convex cambered surfaces convexed towards the lower side of the mounting member.

* * * * *